US007210713B2

(12) United States Patent
Yoshida et al.

(10) Patent No.: US 7,210,713 B2
(45) Date of Patent: May 1, 2007

(54) DOOR MEMBER OPENER APPARATUS FOR VEHICLE

(75) Inventors: Fumihiko Yoshida, Tokyo (JP); Toshiya Shimpo, Tokyo (JP); Hidetaka Inagaki, Tokyo (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 174 days.

(21) Appl. No.: 10/968,164

(22) Filed: Oct. 20, 2004

(65) Prior Publication Data

US 2005/0173937 A1 Aug. 11, 2005

(30) Foreign Application Priority Data

Oct. 21, 2003 (JP) ..... 2003-360819

(51) Int. Cl.
*E05C 3/06* (2006.01)
*E05C 3/16* (2006.01)

(52) U.S. Cl. ..... 292/201; 292/216; 292/DIG. 23; 70/267

(58) Field of Classification Search ..... 292/216, 292/201, DIG. 23; 70/267–274
See application file for complete search history.

(56) References Cited

U.S. PATENT DOCUMENTS 4,219,227 A * 8/1980 Grabner et al. ..... 292/216
4,664,430 A * 5/1987 Bernard ..... 292/201
4,976,477 A * 12/1990 Nakao ..... 292/201
4,978,153 A * 12/1990 Hirsch et al. ..... 292/201
5,564,761 A * 10/1996 Mizuki et al. ..... 292/201
5,613,716 A * 3/1997 Cafferty ..... 292/216
5,639,130 A * 6/1997 Rogers et al. ..... 292/216
5,802,894 A * 9/1998 Jahrsetz et al. ..... 70/264
6,279,972 B1 * 8/2001 Brill et al. ..... 292/216
6,435,573 B1 * 8/2002 Szablewski ..... 292/201
6,474,704 B1 * 11/2002 Rathmann et al. ..... 292/201
6,520,548 B1 * 2/2003 Fisher et al. ..... 292/201
6,523,376 B2 * 2/2003 Baukholt et al. ..... 70/256
6,557,910 B2 * 5/2003 Amano ..... 292/201
6,557,911 B2 * 5/2003 Nelsen et al. ..... 292/216
6,565,131 B2 * 5/2003 Roos ..... 292/201
6,575,003 B1 * 6/2003 Dupont ..... 70/257
6,659,515 B2 * 12/2003 Raymond et al. ..... 292/201
6,848,727 B1 * 2/2005 Cetnar et al. ..... 292/201
6,988,749 B2 * 1/2006 Hashiba et al. ..... 292/201

FOREIGN PATENT DOCUMENTS

EP 0 89 158 A1 3/1994
JP 2001-123722 A 5/2001

* cited by examiner

*Primary Examiner*—Brian E. Glessner
*Assistant Examiner*—Carlos Lugo
(74) *Attorney, Agent, or Firm*—Birch Stewart Kolasch & Birch, LLP

(57) ABSTRACT

A door member opener apparatus for a vehicle includes an engaging mechanism, a lock mechanism, a clearing mechanism, and an ECU (electronic control unit). The engaging mechanism includes a striker and a claw member that rotatively moves to engage with the striker. The engaging mechanism engages a tailgate with a car body. The lock mechanism regulates rotative movement of the claw member. The clearing mechanism clears the regulation of the rotative movement of the claw member when a handle member is operated. The ECU sets the amount of time before the lock mechanism can regulate the rotative movement of the claw member equal to a normal driving time.

3 Claims, 8 Drawing Sheets

DOOR MEMBER OPENER APPARATUS FOR VEHICLE

CROSS-REFERENCE TO RELATED APPLICATIONS

This application is based upon and claims the benefit of priority from prior Japanese Patent Application No. 2003-360819, filed Oct. 21, 2003, the entire contents of which are incorporated herein by reference.

BACKGROUND OF THE INVENTION

1. Field of the Invention

The present invention relates to a door member opener apparatus for a vehicle which engages a door member in a closed state with a car body.

2. Description of the Related Art

An automobile as an example of a vehicle comprises a door member opener apparatus for a vehicle. The door member opener apparatus for a vehicle engages a tailgate with a car body while the tailgate is closed. The tailgate is an example of a door member. The door member opener apparatus for a vehicle disengages the tailgate from the car body when, for example, an electric door handle apparatus is operated.

The door member opener apparatus for a vehicle comprises a striker and a latch mechanism. The striker is fixed to, for example, the car body. The latch mechanism is fixed to the tailgate to engage with the striker. When the striker and the latch mechanism are engaged with each other to close the tailgate, the tailgate engages with the car body.

The latch mechanism comprises a claw member and a housing. The claw member engages with the striker. The housing accommodates the claw member. A notch is formed in the housing so that the striker can enter the notch.

The claw member is rotatively movably supported by the housing so as to be pushed and rotatively moved by the striker entering the housing. The claw member is formed with a concave portion in which the striker is fitted. As the claw member rotatively moves, the striker is fitted into the concave portion. Moreover, the claw member is urged so as to rotatively move in a direction in which the engagement with the striker is cleared.

Thus, the latch mechanism comprises a pawl member to regulate the rotative movement of the claw member. When the claw member engages with the striker, the pawl member mates with a mating portion provided in the claw member. This allows the pawl member to regulate the rotative movement of the claw member to maintain the engagement between the claw member and the striker. The pawl member is supported opposite the claw member across the notch into which the striker advances. The pawl member thus rotatively moves on the same plane as that on which the claw member rotatively moves. The pawl member is urged so as to rotatively move toward the claw member.

The door member opener apparatus for a vehicle also comprises an open actuator. When a handle switch provided in a door handle apparatus is turned on, the open actuator rotatively moves the pawl member in a direction in which the mating with the claw member is cleared.

When opening the tailgate, a passenger operates a handle portion of the door handle apparatus. The passenger operates the handle member to turn on the handle switch. Then, the open actuator rotatively moves the pawl member in the direction in which the mating with the claw member is cleared.

Thus, the mating between the pawl member and the claw member is cleared. Then, the striker and the pawl member are disengaged from each other by an urging force acting on the claw member or the passenger's pulling of the door.

The open actuator stops its driving after starting its driving and the predetermine time being over. Once the driving of the open actuator is stopped, the pawl member is returned toward the claw member by the urging force. In this state, the pawl member is not mated with the mating portion of the claw member. However, closing the tailgate causes the striker to enter the housing of the latch mechanism. The entering striker abuts against the claw member. Then, the striker rotatively moves the claw member. Consequently, the pawl member mates with the claw member again.

On the other hand, the tailgate is adapted to engage with the car body in a half open state so as not to fully open at a time even if the striker and the claw member are disengaged from each other during traveling. The engagement between the striker and the claw member includes a regular engaged state and a half open state corresponding to the regular closed state and half open state of the tailgate. In the regular closed state, the tailgate is fully closed.

Further, the claw member and the pawl member mate with each other in association with the regular engaged state and half open state of the striker and claw member.

Depending on the magnitude of a force exerted by the passenger when closing the door, the tailgate may be half opened rather than being brought into the regular closed state, under the elastic force of a weatherstrip installed between the tailgate and the car body. In this state, the passenger must re-close the tailgate.

When re-closing the tailgate, the passenger first opens the tailgate. Then, in most cases, the passenger closes the tailgate immediately after the opening. Thus, the time for which the tailgate is open is short. On this occasion, the claw member remains free even though the tailgate is closed to a position corresponding to the regular closed state before the released pawl member returns toward the claw member under the urging force.

Consequently, the tailgate returns to a position corresponding to the half open state under the elastic force of the weatherstrip. Then, in this state, the pawl member returns toward the claw member. The pawl member and the claw member mate with each other. In other words, the tailgate engages with the car body in the half open state. Thus, it has been desirable to effectively prevent the half open state of the door.

Thus, it has been proposed that the time for which the open actuator is kept driven when re-closing the tailgate be set shorter than the duration from after the operation of the handle portion until the tailgate is closed to the position corresponding to the regular closed state.

This setting is made in order to mate the claw member with the pawl member when the handle switch is turned off before the tailgate returns from the position for the regular closed state to the position for the half open state.

Alternatively, in connection with a door member opener apparatus for a vehicle disclosed in Jpn. Pat. Appln. KOKAI Publication No. 2001-123722, it has been proposed that the handle switch be turned off to stop driving the open actuator even while the open actuator should be driven. This causes the pawl member to return toward the claw member before the tailgate is closed to the position for the regular closed state.

On the other hand, the passenger may not pull up the tailgate immediately after the operation of the handle portion or may open the tailgate slowly. If the tailgate is not pulled up immediately after the operation, the tailgate is pushed out by the urging force acting on the claw member but may return to the position for the half open state under the weight of the tailgate itself.

Thus, when the driving of the open actuator is stopped before the striker and the claw member are completely disengaged from each other, the claw member and the pawl member mate with each other. The tailgate thus engages with the car body in the half open state.

That is, for some passengers, the time from after the operation of the handle portion until the striker and the claw member are disengaged from each other exceeds the time for which the open actuator is driven. Then, the tailgate cannot be opened. When the driving time of the open actuator is set shorter than the duration of re-closing of the tailgate, this tendency is marked and the tailgate cannot be smoothly opened.

BRIEF SUMMARY OF THE INVENTION

The present invention provides a door member opener apparatus for a vehicle which can effectively open and close a door member.

A door member opener apparatus for a vehicle according to the present invention comprises an engaging mechanism, a lock mechanism, a clearing mechanism, duration detecting means, and control means.

The engaging mechanism comprises a striker and a claw member. The striker is fixed to one of a car body and a door member provided in the car body. The claw member is rotatively movably supported by the other of the door member and the car body. The claw member can be engaged with the striker while the door member is in a regular closed state and in a half open state. The claw member is urged in a direction in which the engagement with the striker is cleared.

The lock mechanism regulates rotative movement of the claw member in a direction of an urging force while the door member is in the regular closed state or in the half open state.

The clearing mechanism clears the regulation, by the lock mechanism, of the rotative movement of the claw member upon a request for opening of the door member. After a first predetermined time has elapsed, the clearing mechanism allows the lock mechanism to regulate the rotative movement of the claw member. The first predetermined time is determined taking re-closing of the door member in the half open state into account.

The duration detecting means detects the duration of the closed state of the door member.

The control means determines that a next request for opening of the door member is not intended to re-close the door member when the duration of the closed state of the door member exceeds a second predetermined time. The control means then sets the amount of time before the lock mechanism can regulate the rotative movement of the claw member, longer than the first predetermined time.

Alternatively, the door member opener apparatus for a vehicle comprises an engaging mechanism, a lock mechanism, a clearing mechanism, half-open-state detecting means, and control means.

The engaging mechanism comprises a striker and a claw member. The striker is fixed to one of a car body and a door member provided in the car body. The claw member is rotatively movably supported by the other of the door member and the car body. The claw member can be engaged with the striker while the door member is in a regular closed state and in a half open state. The claw member is urged in a direction in which the engagement with the striker is cleared.

The lock mechanism regulates rotative movement of the claw member in a direction of an urging force while the door member is in the regular closed state or in the half open state.

The clearing mechanism clears the regulation, by the lock mechanism, of the rotative movement of the claw member upon a request for opening of the door member. After a first predetermined time has elapsed, the clearing mechanism allows the lock mechanism to regulate the rotative movement of the claw member. The first predetermined time is determined taking re-closing of the door member in the half open state into account.

The half-open-state detecting means detects the half open state of the door member.

The control means determines that a next request for opening of the door member is intended to re-close the door member if the door member is half open upon the request. The control means then sets the amount of time before the lock mechanism can regulate the rotative movement of the claw member again, equal to a first predetermined time. If the door member is not half open upon the request, the control means sets the amount of time before the lock mechanism can regulate the rotative movement of the claw member again, longer than the first predetermined time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

With reference to FIGS. 1A to 9, description will be given of a door member opener apparatus 10 for a vehicle according to a first embodiment of the present invention.

Figure 1A:
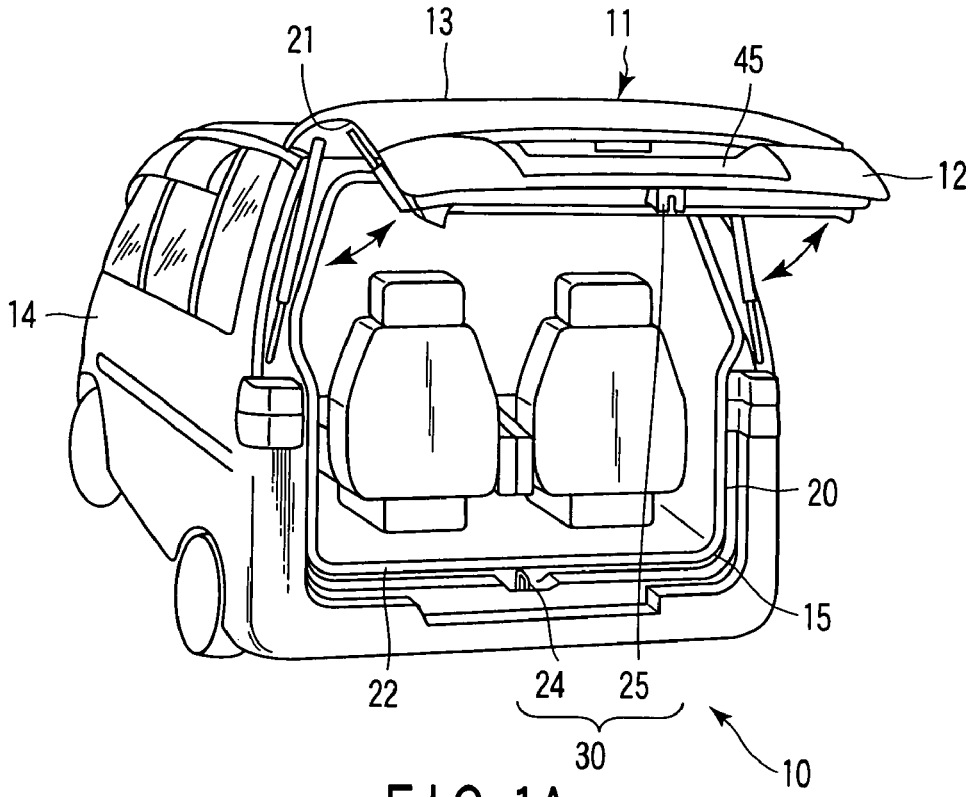
FIG. 1A is a perspective view showing an opened state of a tailgate of an automobile comprising a door member opener apparatus for a vehicle according to a first and second embodiments of the present invention, as viewed from behind the automobile.
Figure 1B:
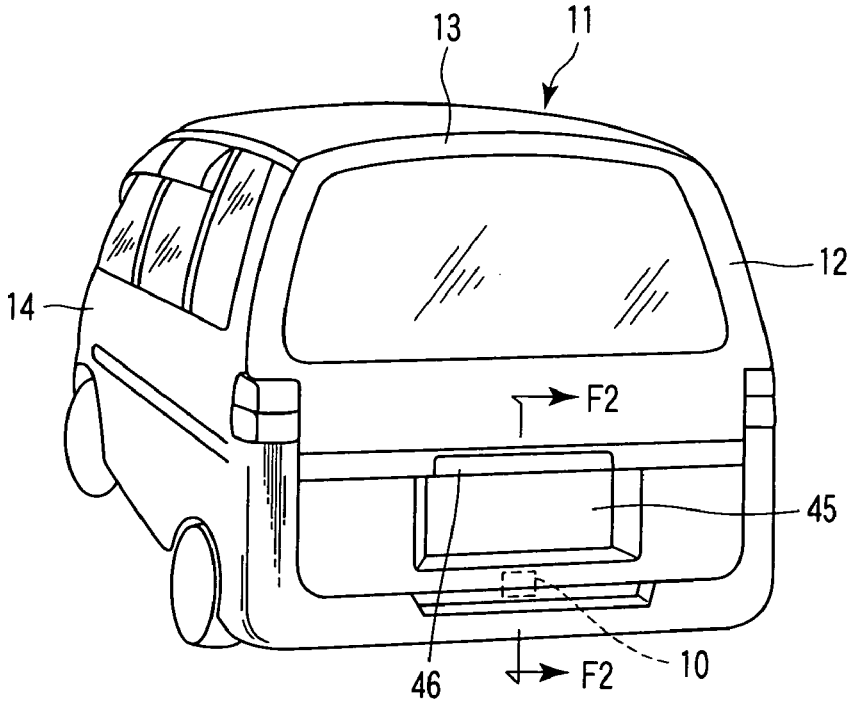
FIG. 1B is a perspective view showing a closed state of the tailgate of the automobile comprising the door member opener apparatus for a vehicle according to the first and second embodiments of the present invention, as viewed from behind the automobile.

FIGS. 1A and 1B show a rear side of an automobile 11 comprising the door member opener apparatus 10 for a vehicle. Reference numeral 15 denotes a rear end of a car body 14 which is open. Reference numeral 12 denotes a tailgate as an example of a door member of the automobile 11. An upper end 13 of the tailgate 12 is rotatably supported by, for example, a hinge at an upper end of an edge 20 of the rear open end 15.

As shown in FIG. 1A, the tailgate 12 is opened by being pulled up. FIG. 1B shows a regular closed state of the tailgate 12. In the regular closed state, the tailgate 12 is fully closed.

A lower end of the tailgate 12 is engaged with the car body 14 by the door member opener apparatus 10 for a vehicle while the tailgate 12 is closed. A weatherstrip 22 is installed between an edge 21 of the tailgate 12 and an edge 20 of the rear open end 15 of the car body 14.

Figure 2:
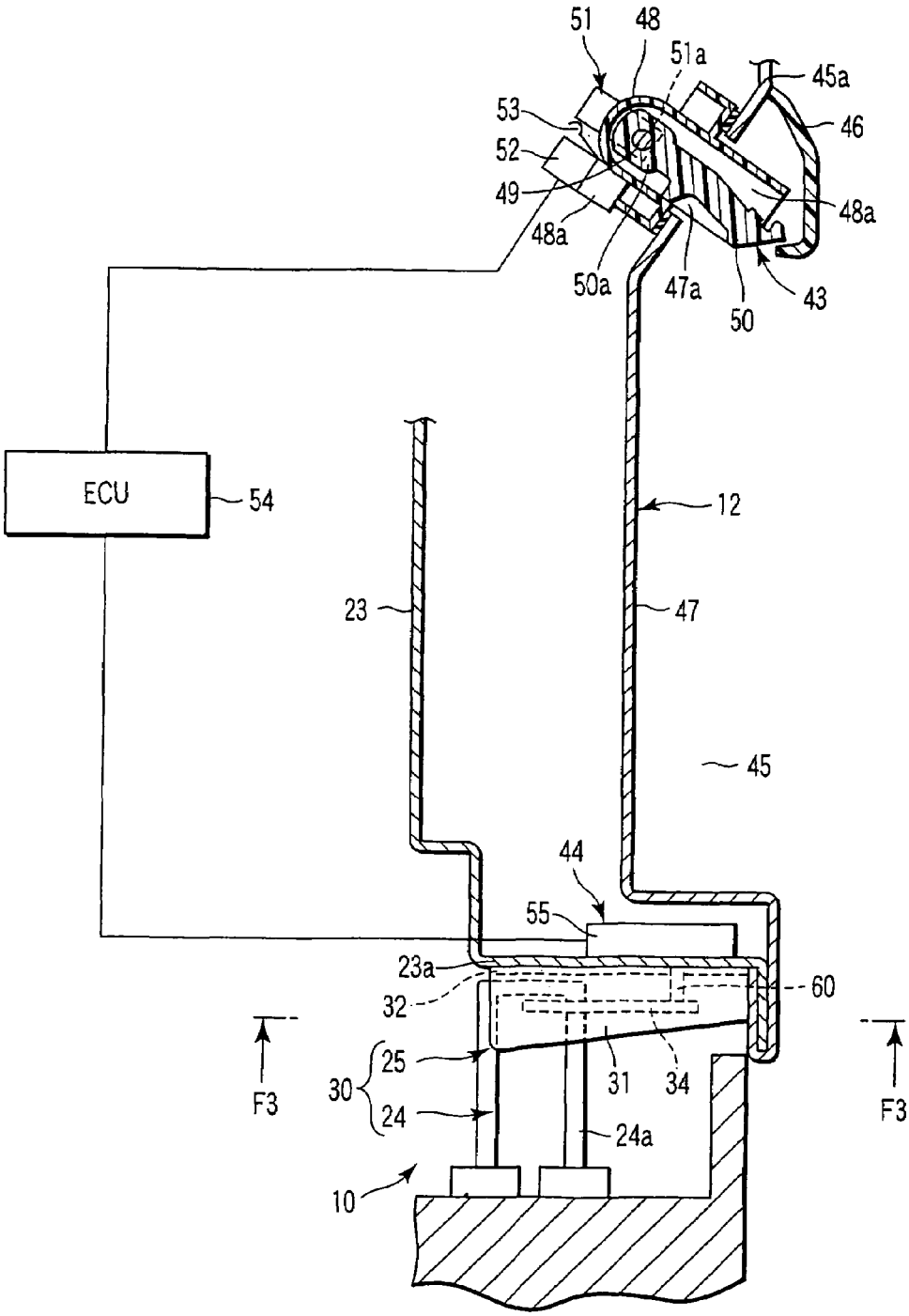
FIG. 2 is a sectional view of the tailgate taken along line F2—F2 shown in FIG. 1B.

FIG. 2 shows a cross section taken along a longitudinal direction and in the substantially center of a car width direction and in which the tailgate 12 is closed. The tailgate 12 has an inner panel 23. The inner panel 23 is located inside the car body 14 while the tailgate 12 is closed. A bottom wall portion 23*a* of the inner panel has, for example, a predetermined width. The width of the bottom wall portion 23*a* extends along the longitudinal direction of the car body 14 while the tailgate 12 is closed.

The door member opener apparatus 10 for a vehicle comprises an engaging mechanism 30. The engaging mechanism 30 comprises a striker 24 and a latch mechanism 25. The striker 24 is fixed to, for example, the lower end of the edge 20 of the rear open end 15 of the car body 14. The striker 24 is substantially U-shaped. Both ends of the striker 24 are arranged along the longitudinal direction of the car body 14. The both ends of the striker 24 are fixed to the lower end of the edge 20.

The latch mechanism 25 is provided on a bottom surface of the bottom wall portion 23*a* of the inner panel 23. The latch mechanism 25 engages releasably with the striker 24. The latch mechanism 25 engages with the striker 24 when the tailgate 12 is closed.

Figure 3:
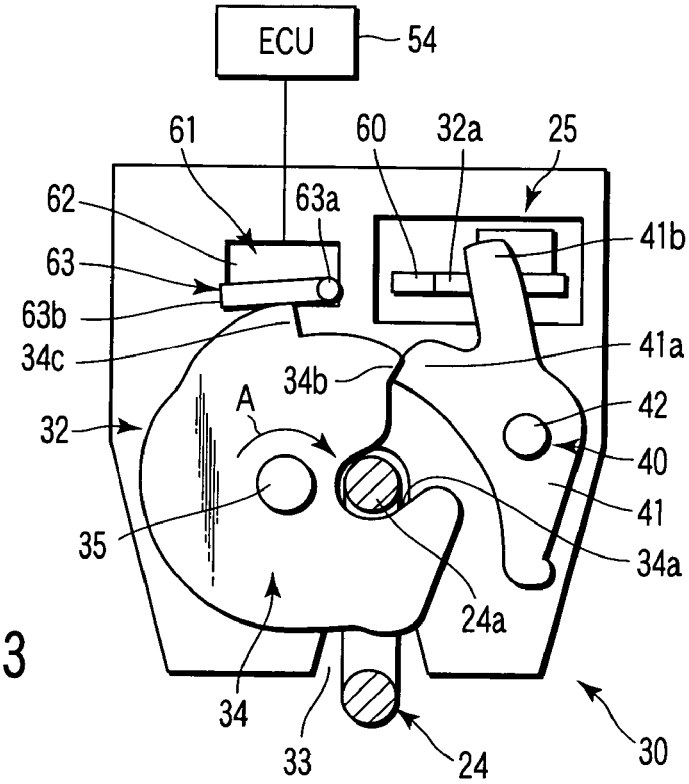
FIG. 3 is a sectional view of an engaging mechanism taken along line F3—F3 shown in FIG. 2.

FIG. 3 shows how the latch member 25 and the striker 24 are engaged with each other while the tailgate 12 is in the regular closed state. The latch mechanism 25 comprises a housing 31. The housing 31 has a base plate 32.

As shown in FIG. 2, the base plate 32 is in contact with, for example, the bottom wall portion 23*a* of the inner panel 23 of the tailgate 12. A notch 33 is formed in the base plate 32.

The notch 33 is formed so that when the tailgate 12 is closed, a rear post portion 24*a* of the striker 24 can advance into the latch mechanism 25. The notch 33 is formed so that, for example, the post portion 24*a* of the striker 24 can advance slightly deeper than in the regular closed state of the tailgate 12.

As shown in FIG. 3, the latch mechanism 25 comprises a claw member 34. The claw member 34 engages with the striker 24. The claw member 34 is like, for example, a plate. The claw member 34 is supported on and along the base plate 32 and substantially parallel to the base plate 32 using a first support shaft 35. A part of the claw member 34 covers the notch 33. A concave portion 34*a* into which the post portion 24*a* of the striker 24 is fitted is formed in an area covering the notch 33.

The claw member 34 is urged in a clockwise direction A in FIGS. 3 to 7 using, for example, a spring. Accordingly, the engagement between the claw member 34 and the striker 24 is not maintained simply by fitting the striker 24 into the concave portion 34*a*.

In FIGS. 3 to 7, in the clockwise direction A, the claw member 34 is urged so as to disengage from the striker 24.

Thus, the latch mechanism 25 comprises a lock mechanism 40. When the claw member 34 engages with the striker 24, the lock mechanism 40 regulates the rotative movement of the claw member 34 in the clockwise direction A.

As shown in FIG. 3, the lock mechanism 40 comprises a pawl member 41. The pawl member 41 is, for example, substantially Y-shaped. The pawl member 41 is supported on the base plate 32 and opposite the first support shaft 35 across the notch 33.

Specifically, a substantial center of the pawl member 41 is rotatively movably supported by a second support shaft 42 on the base plate 32 so that, for example, the pawl member 41 is substantially parallel to the base plate 32. The pawl member 41 is urged using, for example, a spring, so as to rotatively move in a counterclockwise direction in FIGS. 3 to 7.

A first mating convex portion 34*b* is formed on the claw member 34. As shown in FIG. 3, the first mating convex portion 34*b* is formed to lie closer to a rear end of the vehicle than the concave portion 34*a* while the tailgate 12 is in the regular closed state.

The pawl member 41 has a mating convex portion 41*a* formed in one of two branching portions which is closer to the claw member 34. The mating convex portion 41*a* mates with the first mating convex portion 34*b* to regulate the rotative movement of the claw member 34, which is caused by an urging force. Thus, as shown in FIG. 3, the pawl member 41 regulates the rotative movement of the claw member 34. The engagement between the claw member 34 and the striker 24 is thereby maintained while the tailgate 12 is in the regular closed state.

On the other hand, the tailgate 12 engages with the car body 14 even in a half open state. This is to prevent the tailgate 12 from being opened at a time even if the striker 24 and the claw member 34 are disengaged from each other while the automobile 11 is traveling. That is, the closed state of the tailgate 12 includes the regular closed state and the half open state.

Figure 4:
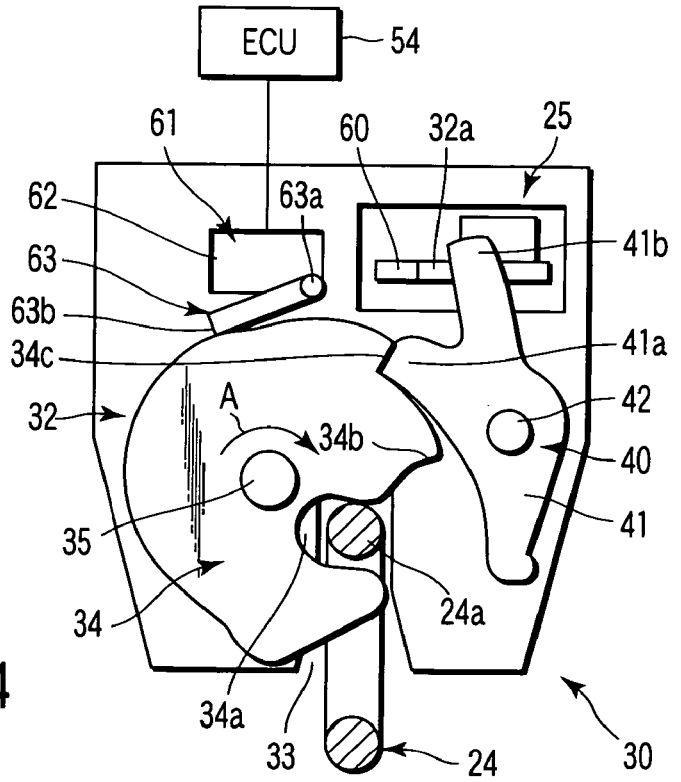
FIG. 4 is a plan view showing a striker and a claw member shown in FIG. 3, wherein the tailgate is half open.

A second mating convex portion 34*c* is formed on the claw member 34 to engage the tailgate 12 in the half open state with the car body 14. The second mating convex portion 34*c* is formed on the claw member 34 and opposite the concave portion 34*a* across the first mating convex portion 34*b* along a periphery of the claw member 34. As shown in FIG. 4, the second mating convex portion 34*c* mates with the mating convex portion 41*a* of the pawl member 41 while the tailgate 12 is half open. This serves to maintain the engagement between the striker 24 and the claw member 34 while the tailgate 12 is half open. That is, the tailgate 12 engages with the car body 14 while half open.

Further, when the passenger requests that the tailgate 12 be opened, it is necessary that the striker 24 and the claw member 34 must be disengaged from each other. To achieve this, the door member opener apparatus 10 for a vehicle comprises a clearing mechanism 44.

The clearing mechanism 44 clears the mating between the claw member 34 and the pawl member 41 in unison with the passenger's operation of a handle member 50 of a tailgate opener handle apparatus 43. As shown in FIG. 2, the tailgate opener handle apparatus 43 is provided in the tailgate 12.

A recess portion 45 is formed in an outer panel 47 of the tailgate 12 so as to extend downward from a substantially central position. The outer panel 47 is located outside. For example, a number plate is attached to the recess portion 45. A door garnish 46 is provided at an upper edge 45*a* of the recess portion 45 along the car width direction.

The tailgate opener handle apparatus 43 is an electric door handle apparatus. The tailgate opener handle apparatus 43 is provided in an area covered with the door garnish 46 of the outer panel 47.

The tailgate opener handle apparatus 43 comprises a base member 48, a handle member 50, a handle switch 52, and a transmission member 51. The base member 48 is assembled, from the inside of the outer panel 47, in an opening 47*a* formed in the outer panel 47. The base member 48 comprises wall portions 48*a* at both ends in the car width direction. The base member 48 is shaped to open backward. Thus, the opening in the base member 48 passes through the opening 47*a* of the outer panel 47 and opens backward.

The handle member 50 is supported on a shaft member 49 provided between the wall portions 48*a* of the base member 48; the handle member 50 can be rotatively moved upward. When the passenger grasps the handle member 50 in order to open the tailgate 12, the handle member 50 is rotatively moved upward.

A side end 51*a* of the transmission member 51 is supported, for example, by the shaft member 49 outside the wall portions 48*a* of the base member 48. The transmission member 51 rotatively moves in unison with the rotative movement of the handle member 50.

The handle switch 52 is a switch which detects an operation of the handle member 50. The handle switch 52 is fixed, for example, to an outer surface of the wall portion 48*a* of the base member 48 below the transmission member 51.

The handle switch 52 comprises a switching lever 53 between itself and the transmission member 51. The switching lever 53 is pressed by the transmission member 51. Specifically, the switching lever 53 is pressed in unison with the rotative movement of the handle member 50. When the switching lever 53 is pressed, the handle switch 52 is turned on to detect an operation of the handle member 50.

The clearing mechanism 44 comprises an open actuator 55 and an open lever 60. The open lever 60 is driven by the open actuator 55. The open actuator 55 is mounted, for example, on a top surface of the bottom wall portion 23*a* of the inner panel 23 of the tailgate 12. The open lever 60 extends from the open actuator 55 toward the latch mechanism 25. As shown in FIGS. 3 to 7, a part of the open lever 60 projects through one end of a groove portion 32*a* formed in the base plate 32 to the claw member 34 and pawl member 41.

As shown in FIG. 3, the pawl member 41 has a clearing convex portion 41*b* formed in one of the two branching portions which is opposite the mating convex portion 41*a*. The groove portion 32*a* is formed substantially along a rotative movement track of the clearing convex portion 41*b*. When the open actuator 55 is driven, the open lever 60 moves the groove portion 32*a* toward the clearing convex portion 41*b*. Then, the open lever 60 abuts against the clearing convex portion 41*b*. The open lever 60 abuts against the clearing convex portion 41*b* to rotatively move the pawl member 41 in the clockwise direction A in FIGS. 3 to 7. Then, as shown in FIG. 5, the open lever 60 clears the mating between the claw member 34 and the pawl member 41.

Figure 5:
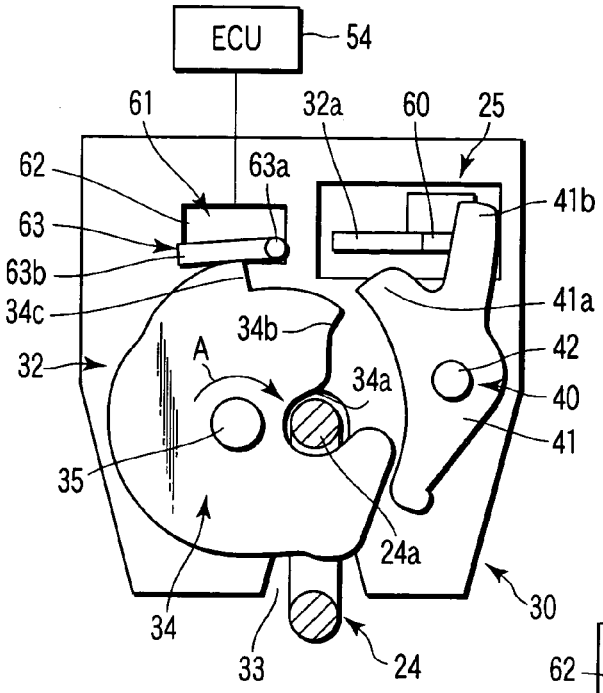
FIG. 5 is a plan view showing the claw member and a pawl member at the moment when the mating between the claw member and the pawl member is cleared in response to the driving of an open actuator.

FIG. 5 shows the moment when the mating between the claw member 34 and the pawl member 41 is cleared while the tailgate 12 is in the regular closed state. Even while the tailgate 12 is half open, the open lever 60 clears the mating between the claw member 34 and the pawl member 41 as previously described.

As shown in FIG. 2, the handle switch 52 and the open actuator 55 are connected an ECU 54. When turned on, the handle switch 52 outputs an electric signal for driving the open actuator 55, to the ECU 54 (electronic control unit).

When the electric signal for driving the open actuator 55 is input the ECU 54, the ECU 54 determines that a request for opening of the tailgate 12 has been made. Then, the ECU 54 starts driving the open actuator 55. Once a predetermined time has passed since the start of the driving of the open actuator 55, the ECU 54 stops driving the open actuator 55. When the driving of the open actuator 55 is stopped, the pawl member 41 is rotatively moved by an urging force in the counterclockwise direction in FIGS. 3 to 7.

Figure 6:
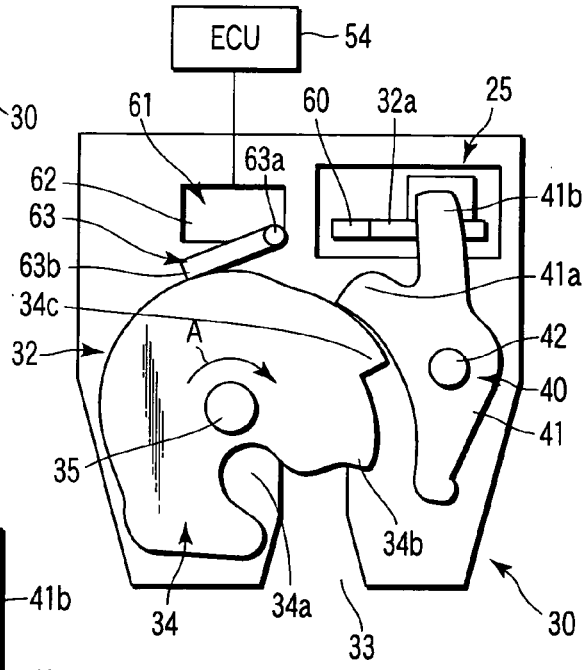
FIG. 6 is a plan view showing the claw member and the pawl member and in which the driving of the open actuator is stopped after the tailgate has been pulled up.

FIG. 6 shows the claw member 34 and the pawl member 41 in the state after the tailgate 12 has been pulled up with the driving of the open actuator stopped. In this state, both the claw member 34 and the pawl member 41 are free. The first mating convex portion 34*b* covers the notch 33.

Thus, when the striker 24 advances into the notch 33 in order to, for example, close the tailgate 12, the post portion 24*a* abuts against the first mating convex portion 34*b* of the claw member 34. Then, the claw member 34 rotatively moves in the counterclockwise direction in FIGS. 3 to 7. The post portion 24*a* of the striker 24 is fitted into the concave portion 34*a* of the claw member 34.

Moreover, when the claw member 34 rotatively moves as the striker 24 advances, the mating convex portion 41*a* of the pawl member 41 climbs over the second mating convex portion 34*c* and first mating convex portion 34*b* of the claw member 34. When the mating convex portion 41*a* of the pawl member 41 climbs over the second mating convex portion 34*c*, the mating convex portion 41*a* can mate with the second mating convex portion 34*c*. When the mating convex portion 41*a* climbs over the first mating convex portion 34*b*, the mating convex portion 41*a* can mate with the first mating convex portion 34*b*.

Thus, while the driving of the open actuator 55 is stopped, the striker 24 and the claw member 34 naturally engage with each other when the tailgate 12 is closed. Then, this engagement is maintained. That is, the striker 24 and the pawl member 34 can be disengaged from each other while the open actuator 55 is carrying out driving. The engagement between the striker 24 and the claw member 34 is maintained while the driving of the open actuator 55 is stopped.

Detailed description will be given of the time for which the open actuator 55 carries out driving. The open actuator 55 comprises a re-closing driving time and a normal driving time. The re-closing driving time is a first predetermined time. The re-closing driving time is used to re-close the tailgate 12 in the half open state. The normal driving time is used to open the tailgate 12 in a normal case. The normal case refers to all cases other than the re-closing of the tailgate 12.

The re-closing driving time will be described. An operation of re-closing the tailgate 12 comprises opening and then closing the tailgate 12. The re-closing does not involve the passenger getting in or out. Consequently, the amount of time after an operation of the handle member 50 and before the tailgate 12 is closed is relatively small.

When the tailgate 12 is closed, the engagement between the striker 24 and the claw member 34 is not maintained even when the tailgate 12 is closed to a position corresponding to the regular closed state while the open actuator 55 is carrying out driving, that is, while the claw member 34 is free. Accordingly, the tailgate 12 may return to a position corresponding to the half open state under the elastic force of the weatherstrip 22. In this state, when the driving of the open actuator 55 is stopped, the second mating convex portion 34*c* of the claw member 34 and the mating convex portion 41*a* of the pawl member 41 mate with each other. The tailgate 12 is thus half opened again.

Thus, desirably, the pawl member 41 returns toward the claw member 34 before the tailgate 12 is closed to the position for the regular closed state. In other words, the first mating convex portion 34*b* of the claw member 34 needs to mate with the mating convex portion 41*a* of the pawl member 41 before the tailgate 12 returns from the regular closed state to the half open state. Consequently, the re-closing driving time is relatively short.

The normal driving time will be described. When the mating between the claw member 34 and the pawl member 41 is cleared, the tailgate 12 is opened by an urging force acting on the claw member 34 and a pull-up force exerted by the passenger. On this occasion, the passenger may pull up the tailgate 12 slowly or may not pull up the tailgate 12 immediately after an operation of the handle member 50.

If the tailgate 12 is pulled up slowly, the tailgate 12 may engage with the car body 14 in the half open state when the driving of the open actuator 55 is stopped before the engagement between the striker 24 and the claw member 34 is completely cleared.

Figure 7:
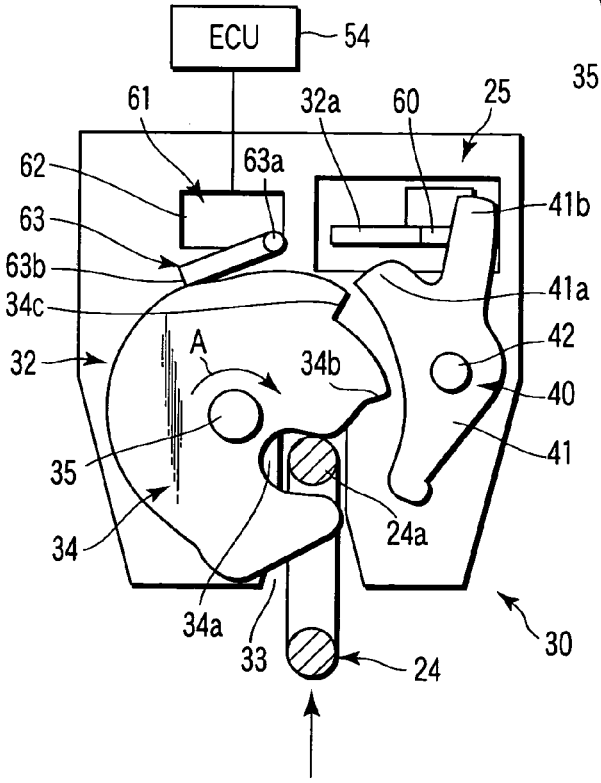
FIG. 7 is a plan view showing the claw member and the pawl member and in which the tailgate is not pulled up immediately after the open actuator has started driving.

If the tailgate 12 is not pulled up immediately after the operation of the handle member 50, the tailgate 12 is pushed out by the urging force of the claw member 34. Subsequently, as shown in FIG. 7, the tailgate 12 sinks under its own weight and returns to the position for the half open state. When the driving of the open actuator 55 is stopped in this state, the tailgate 12 engages with the car body 14 in the half open state.

Accordingly, the normal driving time is set on the basis of the duration until the engagement between the striker 24 and the claw member 34 is completely cleared if the tailgate 12 is opened slowly or is not immediately pulled up. Thus, the normal driving time is set longer than the re-closing driving time.

The door member opener apparatus 10 for a vehicle comprises an ajar switch 61. The ajar switch 61 detects the closed state of the tailgate 12. As shown in FIGS. 3 to 7, the ajar switch 61 is attached to the base plate 32 of the latch mechanism 25.

The ajar switch 61 comprises a main body portion 62 and a detection lever 63. One end 63*a* of the detection lever 63 is rotatively movably supported by the main body portion 62. The other end 63*b* of the detection lever 63 is adapted to contact with the periphery of the claw member 34.

As shown in FIGS. 3 and 4, the detection lever 63 has its position varied between the regular closed state and half open state of the tailgate 12. The ajar switch 61 thus detects the regular closed state and half open state of the tailgate 12. The ajar switch 61 is connected to the ECU 54. The ajar switch 61 outputs, to the ECU 54, electric signals corresponding to the regular close state and half open state of the tailgate 12. The ECU 54 determines the closed state of the tailgate 12 and detects the duration of the each closed state.

The ajar switch 61 and the ECU 54 function as duration detecting means for detecting the duration of the closed state of the tailgate 12. The ajar switch 61 and the ECU 54 also function as half-open-state detecting means for detecting the half open state of the tailgate 12.

Figure 8:
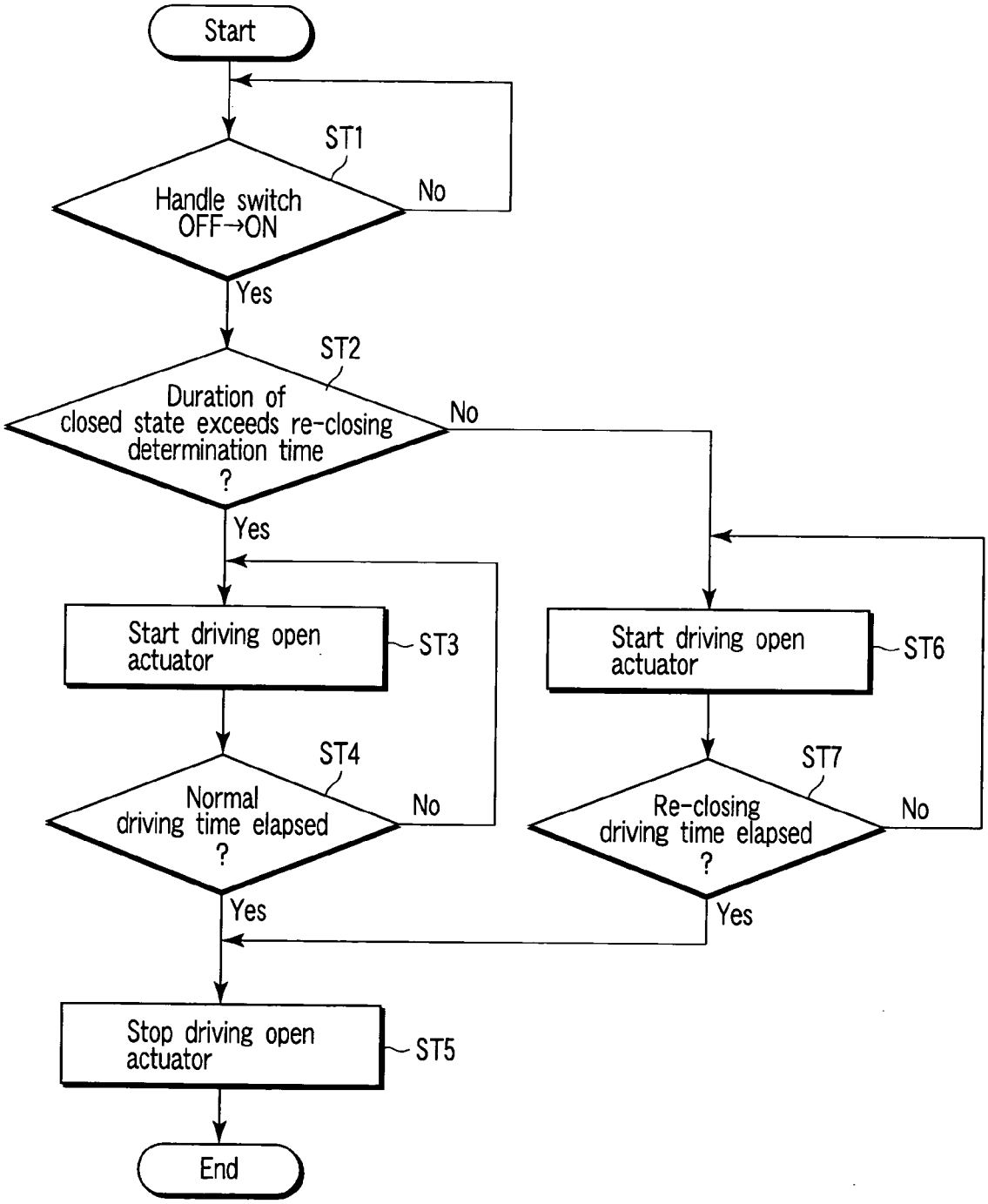
FIG. 8 is a flowchart of opening of the tailgate according to the first embodiment of the present invention.

Now, operations of the door member opener apparatus 10 for a vehicle will be described with reference to the flowchart shown in FIG. 8. To open the tailgate 12, the passenger operates the handle member 50 of the tailgate opener handle apparatus 43. When the handle switch 52 is turned on, it inputs the electric signal for driving the open actuator 55, to the ECU 54. As shown in FIG. 8, when the handle switch 52 inputs the electric signal for driving the open actuator 55, to the ECU 54 in step ST1, the process proceeds to step ST2.

In step ST2, the ECU 54 determines whether or not the duration of the closed state of the tailgate 12 until the handle member 50 is operated exceeds a re-closing determination time. The re-closing determination time is a second predetermined time.

The re-closing determination time is set on the basis of the duration from the time when the tailgate 12 is half opened until the passenger subsequently operates the handle member 50 in order to re-close the tailgate 12.

That is, when the duration of the closed state of the tailgate 12 until the handle member 50 is operated exceeds the re-closing determination time, the ECU 54 determines that the operation of the handle member 50 is one in the normal case. In other words, the ECU 54 determines that this operation is not the re-closing of the tailgate 12.

As shown in FIG. 3, if the passenger opens the tailgate 12 in the closed state, when the duration of the closed state of the tailgate 12 exceeds the re-closing determination time, the process proceeds to step ST3. In step ST3, the ECU 54 starts driving the open actuator 55. When the driving of the open actuator 55 is started, the open lever 60 moves toward the pawl member 41.

The open lever 60 moves toward the pawl member 41 and abuts against the clearing convex portion 41*b* of the pawl member 41. Then, the open lever 60 rotatively moves the pawl member 41 in the clockwise direction A in FIGS. 3 to 7.

As shown in FIG. 5, when the pawl member 41 rotatively moves in the clockwise direction A, the mating between the claw member 34 and the pawl member 41 is cleared. Consequently, the engagement between the claw member 34 and the striker 24 is cleared.

Figure 9:
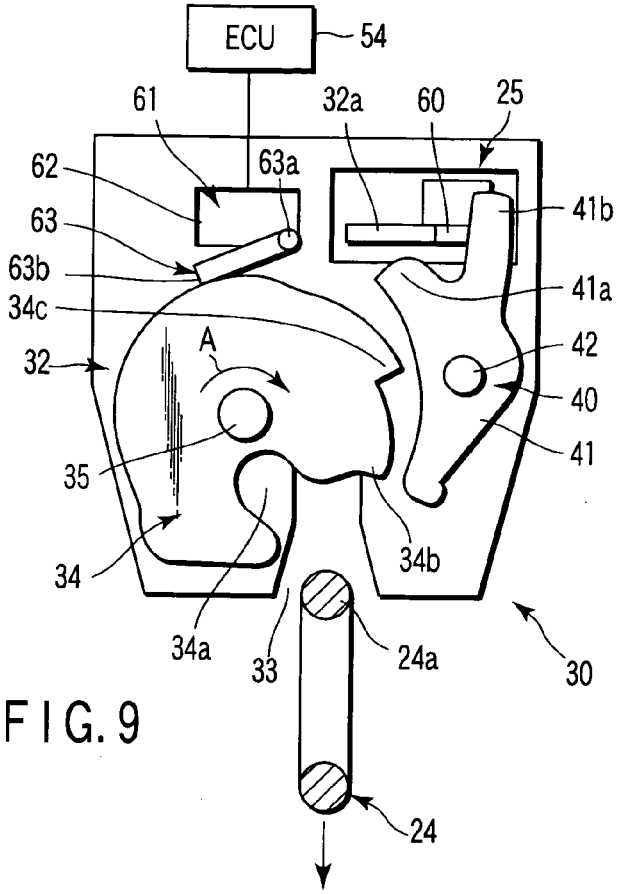
FIG. 9 is a plan view showing the claw member and the pawl member and in which the driving of the open actuator is started with the tailgate pulled up.

As a result, the claw member 34 becomes free. Consequently, as shown in FIG. 9, the claw member 34 rotationally moves under the urging force. Further, when the passenger pulls up the tailgate 12, the claw member 34 abuts against the striker 24 and then rotatively moves.

Then, the process proceeds to step ST4. In step ST4, it is determined whether or not the driving time of the open actuator 55 exceeds the normal driving time. When the driving time of the open actuator 55 exceeds the normal driving time, the process proceeds to step ST5.

In step ST5, the ECU 54 stops driving the open actuator 55. Accordingly, the passenger can pull up the tailgate 12 within the normal driving time. The ECU 54 functions as control means for switching the driving time of the open actuator 55 to the normal driving time once the duration of the closed state of the tailgate 12 exceeds the re-closing determination time.

In this state, the tailgate 12 has been pulled up as shown in FIG. 6. The pawl member 41 has returned toward the claw member under the urging force.

Then, to close the tailgate 12, the passenger pulls down the tailgate 12. Then, the post portion 24*a* of the striker 24 advances into the notch 33. On this occasion, the first mating convex portion 34*b* of the claw member 34 is positioned so as to cover the notch 33. Thus, the post portion 24*a* of the striker 24 abuts against the first mating convex portion 34*b* of the claw member 34.

Then, the claw member 34 is pushed by the striker 24 and thus rotatively moved in the counterclockwise direction in FIGS. 3 to 7. At this time, the post portion 24*a* of the striker 24 is fitted into the concave portion 34*a* of the claw member 34. Consequently, the striker 24 and the claw member 34 are engaged with each other. As the claw member 34 rotatively moves, the mating convex portion 41*a* of the pawl member 41 climbs over the second mating convex portion 34*c* and first mating convex portion 34*b* of the claw member 34.

When the passenger fully closes the tailgate 12, the first mating convex portion 34*b* of the claw member 34 and the mating convex portion 41*a* of the pawl member 41 mate with each other. Consequently, the tailgate 12 engages with the car body 14 in the regular closed state.

If the passenger re-closes the tailgate 12 within the re-closing determination time while the tailgate 12 is half open as shown in FIG. 4, the ECU 54 starts driving the open actuator 55 in step ST6. This operation is similar to that in step ST3. The passenger can re-close the tailgate 12 within the re-closing driving time. Then, once the re-closing driving time has elapsed since the start of driving of the open actuator 55, the process proceeds to step ST5. In step ST5, the ECU 54 stops driving the open actuator 55.

With the door member opener apparatus 10 for a vehicle configured as previously described, in the cases other than the re-closing of the tailgate 12, even if the passenger opens the tailgate 12 slowly, it is possible to reduce the possibility that the engagement of the engaging mechanism 30 is fixed with the tailgate 12 half open.

That is, suitable driving times of the open actuator 55 are set for the re-closing of the tailgate 12 and for the normal case. Thus, the tailgate 12 is effectively opened and closed.

Of course, the re-closing determination time can be appropriately changed in accordance with the passenger or the automobile 11.

Figure 10:
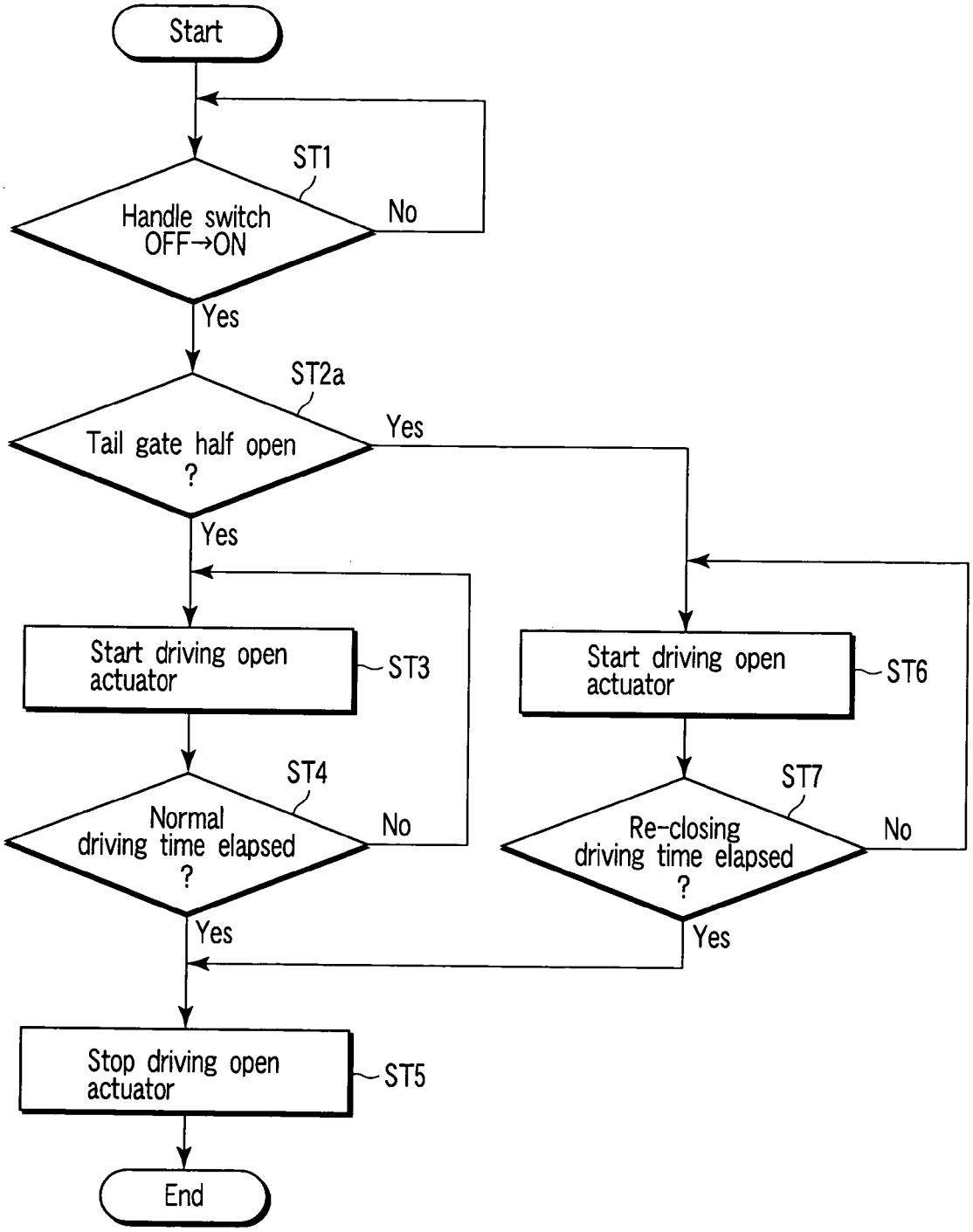
FIG. 10 is a flowchart of opening of the tailgate according to the second embodiment of the present invention.

With reference to FIG. 10, description will be given of operations of a door member opener apparatus 10 for a vehicle according to a second embodiment of the present invention. Arrangements and steps having functions similar to those of the first embodiment are denoted by the same reference numerals, so that their description is omitted.

In the second embodiment, it is determined whether an operation of the handle member 50 corresponds to the re-closing or the normal case on the basis of the closed state of the tailgate 12 during the operation of the handle member 50.

As shown in FIG. 10, in step ST1, when the handle switch 52 is turned on, the process proceeds to step ST2*a*. In step ST2*a*, the ECU 54 determines whether or not the tailgate 12 is half open during the operation of the handle member 50. If the tailgate 12 is half open, the ECU 54 determines that the operation of the handle member 50 corresponds to the re-closing of the tailgate 12. Then, the process proceeds to step ST6. In ST2*a*, if the tailgate 12 is in the regular closed state, the ECU 54 determines that the operation of the handle member 50 corresponds to the normal case instead of the re-closing. In this case, the process proceeds to step ST3.

With the door member opener apparatus 10 for a vehicle according to the second embodiment, in the cases other than the re-closing of the tailgate 12, even if the passenger opens the tailgate 12 slowly, it is possible to reduce the possibility that the engagement of the engaging mechanism 30 is fixed with the tailgate 12 half open.

That is, suitable driving times of the open actuator 55 are set for the re-closing of the tailgate 12 and for the normal case. Thus, the tailgate 12 is effectively opened and closed similar to those of the first embodiment.

Moreover, if the tailgate 12 is half open during an operation of the handle member 50, it is determined that the operation corresponds to the re-closing. This allows the tailgate 12 in the half open state to be reliably closed.

Figure 11:
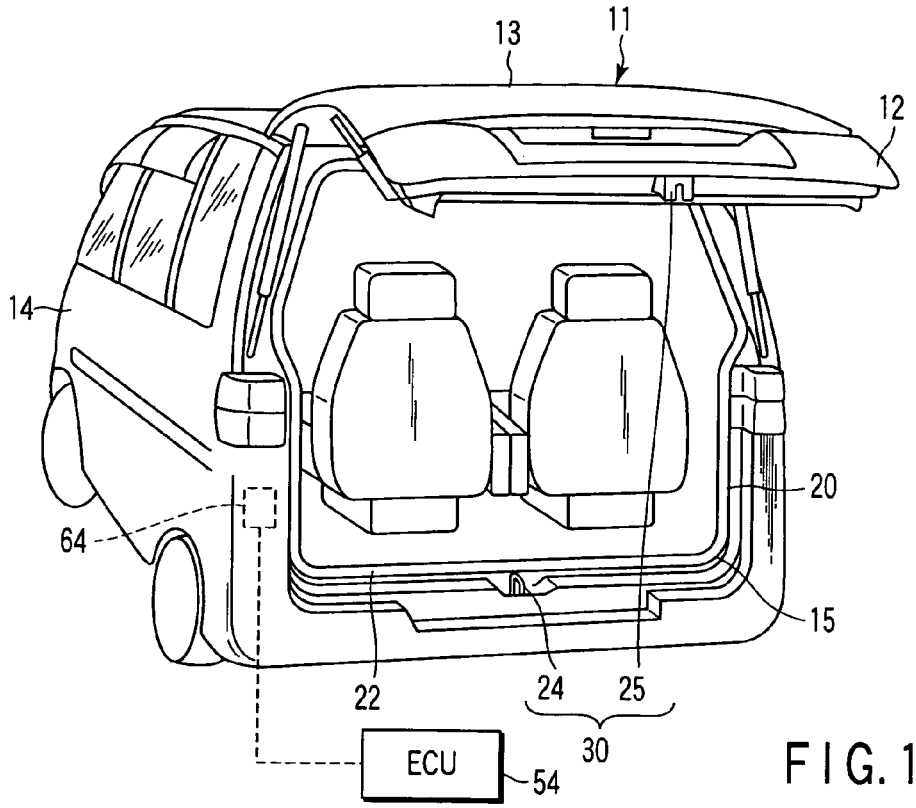
FIG. 11 is a perspective view showing an opened state of a tailgate of an automobile comprising a door member opener apparatus for a vehicle according to a third embodiment of the present invention, as viewed from behind the automobile.
Figure 12:
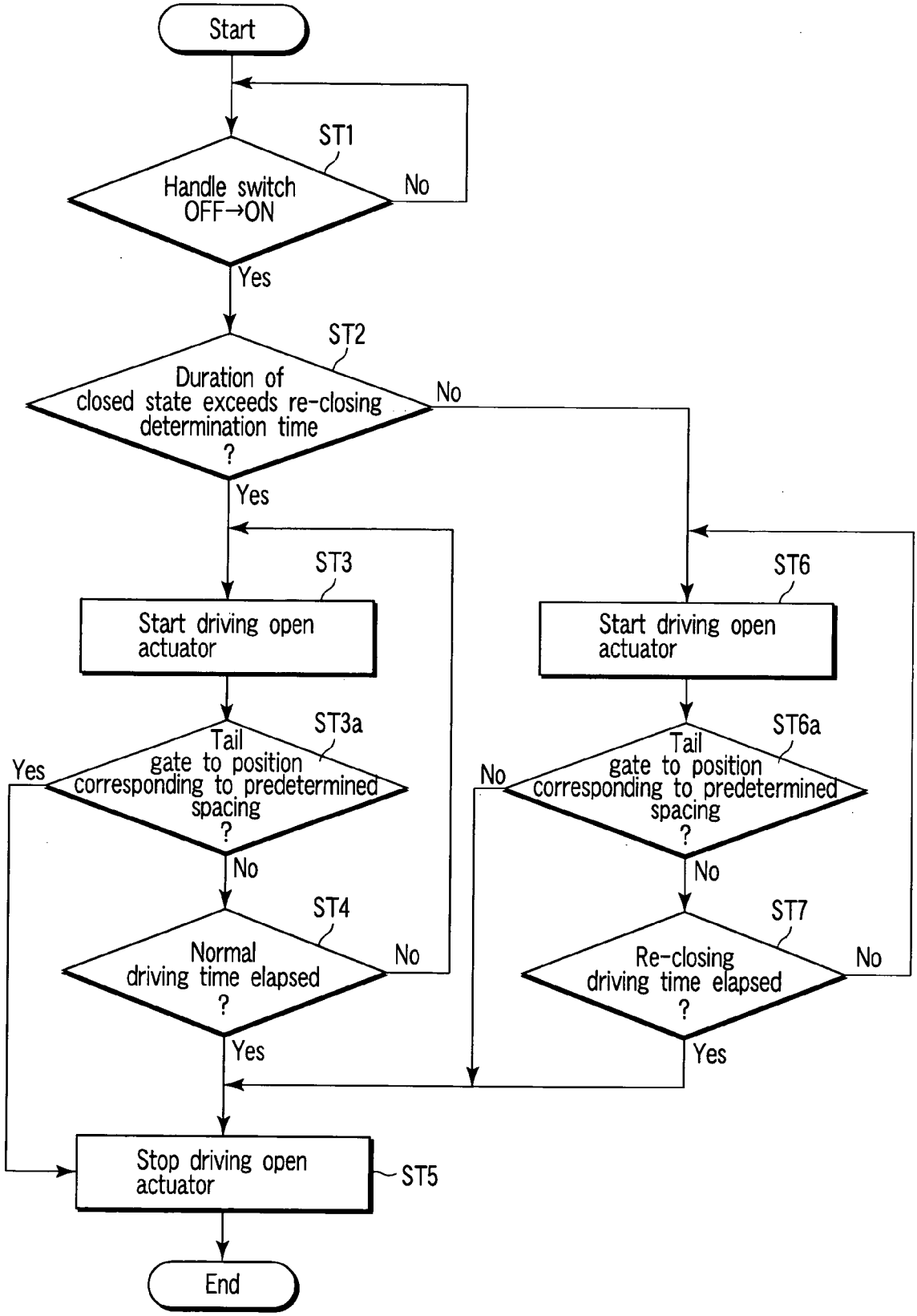
FIG. 12 is a flowchart of opening of the tailgate according to the third embodiment of the present invention.

With reference to FIGS. 11 and 12, description will be given of a door member opener apparatus 10 for a vehicle according to a third embodiment of the present invention. Arrangements and steps having functions similar to those of the first embodiment are denoted by the same reference numerals, so that their description is omitted.

The door member opener apparatus 10 for a vehicle according to the third embodiment comprises an open state detecting sensor 64. The open state detecting sensor 64 is a sensor which detects the spacing between the car body 14 and the tailgate 12 when the tailgate 12 is opened. The open state detecting sensor 64 is an example of means for open state detecting means. As shown in FIG. 11, the open state detecting sensor 64 is attached to a rear end of the car body 14.

The open state detecting sensor 64 is connected to the ECU 54. The open state detecting sensor 64 outputs an electric signal corresponding to the spacing between the car body 14 and the tailgate 12, to the ECU 54.

Now, with reference to FIG. 12, description will be given of operations of the door member opener apparatus 10 for a vehicle according to the third embodiment. In the third embodiment, as shown in the first embodiment, it is determined whether or not an operation of the handle member 50 is intended to re-close the tailgate 12 on the basis of the duration of the closed state of the tailgate 12.

As shown in FIG. 12, in step ST2, when the duration of the closed state of the tailgate 12 exceeds the re-closing determination time, the process proceeds to step ST3. In step ST3, the ECU 54 drives the open actuator 55. Then, the process proceeds to step ST3*a*. In step ST3*a*, the ECU 54 determines whether or not the spacing between the car body 14 and the tailgate 12 reaches predetermined value.

The predetermined spacing is set on the basis of, for example, the spacing between the car body 14 and the tailgate 12 which is required by the passenger to close the tailgate 12 to the position for the regular closed state without using an excessive force. Specifically, to close the tailgate 12, the passenger urges the tailgate 12 in a direction in which it is closed. This urging force increases with the size of the spacing between the car body 14 and the tailgate 12. That is, the predetermined spacing is such that the urging force acting on the tailgate 12 has a magnitude enough to allow the tailgate 12 to be closed to the position for the regular closed state without using an excessive force.

Once the tailgate 12 has opened to the position corresponding to the predetermined spacing, the process proceeds to step ST5. In step ST5, the ECU 54 stops driving the open actuator 55. This allows the tailgate 12 to engage with the car body 14 in the regular closed state even if the tailgate 12 is closed within the normal driving time.

If the tailgate 12 has not been opened to the position corresponding to the predetermined spacing, the process proceeds to step ST4. In step ST4, it is determined whether or not the driving time of the open actuator 55 exceeds the normal driving time.

In step ST4, if the driving time of the open actuator 55 does not exceed the normal driving time, the process returns to step ST3. Even if the tailgate 12 is not opened until the spacing between the car body 14 and the tailgate has a predetermined value, when the driving time of the open actuator 55 exceeds the normal driving time, the process proceeds from step ST4 to step ST5.

On the other hand, in step ST2, when the passenger operates the handle member 50 within the re-closing determination time, that operation is determined to be the re-closing of the tailgate 12. If the tailgate 12 is to be re-closed, the process proceeds to step ST6. In step ST6, the ECU 54 starts driving the open actuator 55.

Then, the process proceeds to step ST6*a*. In step ST6*a*, the ECU 54 determines whether or not the spacing between the car body 14 and the tailgate 12 has a predetermined value. The predetermined spacing is as described above. In this case, when the spacing between the car body 14 and the tailgate 12 has the predetermined value, the process proceeds to step ST5.

Thus, even if the tailgate 12 is closed within the re-closing driving time, it engages with the car body 14 in the regular closed state. That is, the half open state is prevented.

If the spacing between the tailgate 12 and the car body 14 does not have the predetermined value, the process proceeds to step ST7. In step ST7, it is determined whether or not the driving time of the open actuator 55 exceeds the re-closing driving time. In this case, when the driving time of the open actuator 55 does not exceed the re-closing driving time, the process returns to step ST6. Even if the spacing between the tailgate 12 and the car body 14 does not have the predetermined value, when the driving time of the open actuator 55 exceeds the re-closing driving time, the process proceeds from step ST7 to step ST5.

With the door member opener apparatus 10 for a vehicle according to the third embodiment, when the tailgate 12 is to be re-closed, the driving time of the open actuator 55 is set equal to a time suitable for the re-closing of the tailgate 12. For a normal operation of the tailgate 12, the driving time of the open actuator 55 is set equal to a time suitable for the normal operation.

Further, with the door member opener apparatus 10 for a vehicle according to the third embodiment, when the spacing between the car body 14 and the tailgate 12 has the predetermined value, the driving of the open actuator 55 is stopped. Consequently, when the tailgate 12 is to be re-closed, it is pulled up from the car body 14 to the position corresponding to the predetermined spacing before being closed. This allows the tailgate 12 to engage with the car body 14 in the regular closed state even when the tailgate 12 is closed to the position for the regular closed state within the re-closing driving time. This also applies to the normal case.

That is, the tailgate 12 can be more effectively opened and closed.

The means for detecting the predetermined spacing between the tailgate 12 and the car body 14 is not limited to the open state detecting sensor 64. Means different from the open state detecting sensor 64 may be used.

Further, of course, the predetermined spacing between the car body 14 and the tailgate 12 may be appropriately changed in accordance with the passenger or the automobile 11.

Furthermore, determinations for the re-closing of the tailgate 12 are made on the basis of the duration of the closed state of the tailgate 12. However, the present invention is not limited to this. For example, as shown in the second embodiment, determinations for the re-closing of the tailgate 12 may be made on the basis of the closed state of the tailgate 12.

In the first to third embodiments, the striker 24 is fixed to the car body 14. The latch mechanism 25 and the clearing mechanism 44 are fixed to the tailgate 12. However, the present invention is not limited to this. For example, the latch mechanism 25 and the clearing mechanism 44 may be fixed to the car body 14. The striker may be fixed to the tailgate 12.

The door member opener apparatus 10 for a vehicle is employed for the tailgate 12. However, the present invention is not limited to this. The door member opener apparatus 10 for a vehicle may be employed, for example, for a driver's door or a passenger's door.

Of course, the re-closing driving time and the normal driving time may be appropriately changed in accordance with the passenger or the automobile 11.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A door member opener apparatus for a vehicle comprising:

an engaging mechanism comprising a striker and a claw member, the striker being fixed to one of a car body and a door member provided in the car body, the claw member being rotatively movably supported by the other of the door member and the car body, the claw member being capable of being engaged with the striker while the door member is in a regular closed state and in a half open state, the claw member being urged in a direction in which the engagement with the striker is cleared;

a lock mechanism which regulates rotative movement of the claw member in the direction of an urging force while the door member is in the regular closed state or in the half open state;

a clearing mechanism which clears the regulation, by the lock mechanism, of the rotative movement of the claw member upon a request for opening of the door member, the clearing mechanism allowing the lock mechanism to regulate the rotative movement of the claw member after a first predetermined time has elapsed, the first predetermined time being determined taking re-closing of the door member in the half open state into account;

duration detecting means for detecting the duration of the closed state of the door member; and control means for determining that a next request for opening of the door member is not intended to re-close the door member when the duration of the closed state of the door member exceeds a second predetermined time, the control means then setting the amount of time before the lock mechanism can regulate the rotative movement of the claw member, longer than the first predetermined time.

2. A door member opener apparatus for a vehicle comprising:

an engaging mechanism comprising a striker and a claw member, the striker being fixed to one of a car body and a door member provided in the car body, the claw member being rotatively movably supported by the other of the door member and the car body, the claw member being capable of being engaged with the striker while the door member is in a regular closed state and in a half open state, the claw member being urged in a direction in which the engagement with the striker is cleared;

a lock mechanism which regulates rotative movement of the claw member in the direction of an urging force while the door member is in the regular closed state or in the half open state;

a clearing mechanism which clears the regulation, by the lock mechanism, of the rotative movement of the claw member upon a request for opening of the door member, the clearing mechanism allowing the lock mechanism to regulate the rotative movement of the claw member after a first predetermined time has elapsed, the first predetermined time being determined taking re-closing of the door member in the half open state into account;

half-open-state detecting means for detecting the half open state of the door member; and control means for determining that a next request for opening of the door member is intended to re-close the door member if the door member is half open upon the request, the control means then setting the amount of time before the lock mechanism can regulate the rotative movement of the claw member again, equal to a first predetermined time, the control means setting the amount of time before the lock mechanism can regulate the rotative movement of the claw member again, longer than the first predetermined time if the door member is not half open upon the request.

3. The door member opener apparatus for a vehicle according to claim 1 or claim 2, which further comprises an open-state detecting means for detecting that the door member has been opened to a position corresponding to a predetermined spacing, and in which once the door member has been opened to the position corresponding to the predetermined spacing, the lock mechanism can regulate the rotative movement of the claw member.

* * * * *